US008152396B2

(12) United States Patent
Kuykendall

(10) Patent No.: US 8,152,396 B2
(45) Date of Patent: Apr. 10, 2012

(54) FUNCTION FIRST GRIP

(76) Inventor: Stephanie Flint Kuykendall, Claremore, OK (US)

( * ) Notice: Subject to any disclaimer, the term of this patent is extended or adjusted under 35 U.S.C. 154(b) by 440 days.

(21) Appl. No.: 12/436,142

(22) Filed: May 6, 2009

(65) Prior Publication Data

US 2009/0279936 A1 Nov. 12, 2009

Related U.S. Application Data

(60) Provisional application No. 61/050,898, filed on May 6, 2008.

(51) Int. Cl.
*A46B 5/02* (2006.01)

(52) U.S. Cl. ..... 401/6; 16/430; 401/7; 224/217

(58) Field of Classification Search ..... 401/6–8, 401/48; 15/443, 435, 437; 224/218, 267, 224/217; 434/162; 16/430
See application file for complete search history.

(56) References Cited

U.S. PATENT DOCUMENTS

| | | | | | |
|---|---|---|---|---|---|
| 3,947,977 | A * | 4/1976 | Bishop | 434/166 |
| 4,596,335 | A * | 6/1986 | Hull | 211/69.1 |
| 4,885,818 | A * | 12/1989 | Arterbury | 16/430 |
| 4,944,766 | A * | 7/1990 | Williams | 623/65 |
| 5,310,345 | A * | 5/1994 | Gershon | 434/166 |
| 5,320,438 | A * | 6/1994 | Yang | 401/6 |
| 5,391,010 | A * | 2/1995 | Gorbunov | 401/8 |
| 5,626,430 | A * | 5/1997 | Bistrack | 401/6 |
| 5,662,423 | A * | 9/1997 | Walden | 401/7 |
| 5,971,642 | A * | 10/1999 | O'Mara et al. | 401/8 |
| 6,009,600 | A * | 1/2000 | Egeland et al. | 16/436 |
| 6,254,293 | B1 * | 7/2001 | Citrenbaum | 401/6 |
| 6,328,494 | B1 * | 12/2001 | Moxon | 401/8 |
| 6,637,962 | B1 * | 10/2003 | Roche et al. | 401/7 |
| 6,705,788 | B2 * | 3/2004 | Gadberry | 401/6 |
| 6,773,183 | B2 * | 8/2004 | Geddes et al. | 401/6 |
| 6,881,065 | B1 * | 4/2005 | Land | 434/166 |
| 7,661,896 | B2 * | 2/2010 | Zawitz | 401/6 |
| 2006/0083575 | A1 * | 4/2006 | Kim | 401/6 |
| 2007/0228092 | A1 * | 10/2007 | Hammermeister | 224/218 |
| 2008/0014009 | A1 * | 1/2008 | Bush et al. | 401/7 |
| 2008/0217507 | A1 * | 9/2008 | McKenzie et al. | 248/689 |

FOREIGN PATENT DOCUMENTS

JP 2009083359 A * 4/2009

* cited by examiner

*Primary Examiner* — David J. Walczak
*Assistant Examiner* — Jennifer C Chiang
(74) *Attorney, Agent, or Firm* — Michael Ries

(57) ABSTRACT

A writing instrument grip apparatus for holding a writing instrument for performing writing, the apparatus includes a first member adapted to receive a user's thumb and index and side of middle fingers and having a substantially vertical cylindrical chamber for receiving the writing instrument adapted to extend past a bottom surface of the first member for contacting a surface for performing writing; and a second member adapted to receive a user's middle, ring, and small fingers coupled to a top of the first member so that motion of the hand of the user powers the writing instrument for performing the writing in response to the motion; wherein pressure is directed away from joints of the thumb and at least one finger of the hand of the user.

8 Claims, 5 Drawing Sheets

FUNCTION FIRST GRIP

REFERENCE TO RELATED APPLICATIONS

This patent application claims the benefit of U.S. Provisional Application No. 61/050,898 filed on 6 May 2008, the disclosure of which is incorporated herein in its entirety by reference.

BACKGROUND OF THE INVENTION

1. Field of the Invention

The present invention relates generally to a device that holds a pen or pencil and, when gripped by a user positions the thumb and fingers into an ergonomically correct position in order to effectively relieve stress and pain in the users hand while doing handwriting tasks and improves coordination in a developing or injured hand unable to write efficiently.

2. Description of Related Art

When using a pen or pencil, a normally healthy person grips the writing instrument between the tips of his/her thumb and index finger, and sometimes the third and/or fourth fingers are used to provide additional support. During use, as a writer continues to write, he/she over time may gradually squeeze the writing instrument harder and harder by increasing the amount of force that is applied to the writing instrument by pressing the pads of his/her fingers against the writing instrument to both prevent the user's fingers from sliding down toward the end of the writing instrument and to urge the writing instrument to press down against the paper. Extensive use of hand held writing instruments by people who write can result in tendonitis also known as writer's cramp. To relieve the stress and pain, a person, whether child or adult, may develop an incorrect grip while writing. This incorrect grip leads to injury of the joints of the thumb and fingers that keep the person from writing neatly and efficiently—meaning clearly written words, of high quality, which are legible, and created at a speed necessary to stay on task at work or at school or within the home.

Prior to a writer being aware that he/she is developing writer's cramp or joint injury, various letters of the words being written on the paper will gradually become illegible and the writing will be less neat. At some time thereafter, the writer will notice a pain or numbness in his/her fingers and possibly his/her forearm of the writing hand, and will have to stop writing and rest for a short time. A side effect of writer's cramp is that the discomfort experienced by the writer can become both a distraction to the writer's train of thought and will increase the time needed to finish the handwriting task.

Pain, discomfort and/or numbness when writing may also be experienced by a person with a joint disorder, with unstable joints or with poor muscle control, a person that experiences difficulties in holding a pen or pencil in the traditional way, or a person who has experienced a recent injury in his/her writing hand or arm.

Children learning to write may be unable to correctly hold a pencil because of his/her undeveloped fine motor skills. They will write inefficiently producing a written product that lacks quality equal to the thought process of the child. Because their joints are not stable and their muscle control is not yet developed enough to do the writing tasks assigned to them, these children will often try one of many awkward, ineffective handwriting grips. These awkward grip positions are functionally incorrect hand positions on a writing utensil that sadly, become habitual. Over time, they suffer from tendonitis and pain because the awkward writing grip is not an ergonomically correct position.

In addition, some people are unable to correctly hold a pencil or pen because they suffer from a joint disorder, an injury to the hand, or poor muscle control due to a medical condition. These people will experience pain or difficultly when they attempt to write if they are unable to stabilize the pencil or pen effectively.

In these above listed situations, when the correct pencil grip can not be obtained there are a variety of incorrect, awkward hand positions on the writing utensil that a person will use as they try to find a comfortable grip for writing. Some of the positions cause joint destabilization including, but not limited to, thumb interphalangeal joint hyperextension or hyperflexion, thumb metacarpophalangeal joint hyperflexion or hyperextension; index finger interphalangeal hyperextension or hyperflexion, just to list a few. When the incorrect handwriting grip becomes habitual, over time the excessive amount of pressure on these joints in the above listed positions of the dominant hand often result in the need for medical care to address the pain, injury, or numbess caused by joint destabilization or tendonitis.

What is needed is an apparatus that can hold a writing instrument such as a pen or a pencil and, when gripped by a person will open the webspace of the hand, stabilize the joints of the thumb and finger, support the arch of the hand and allow the ring and small fingers to give extra support during writing. Writers need an apparatus that will not only effectively prevent hand stress during handwriting tasks, but will allow a person who has difficulty holding a writing instrument to now more easily perform a hand writing task while holding the writing instrument using a correct writing grasp.

SUMMARY OF THE INVENTION

In an exemplary embodiment of the present invention, there is disclosed a writing instrument grip apparatus for holding a writing instrument to facilitate the writing process. This apparatus comprises:

a first member adapted to receive a user's thumb and index and side of middle finger and having a substantially vertical cylindrical chamber for receiving said writing instrument adapted to extend past a bottom surface of said first member for contacting a surface for performing writing; and a second member adapted to receive a users middle, ring, and small fingers coupled to a top of said first member so that motion of the hand of the user powers said writing instrument for performing the writing in response to said motion;

wherein excessive pressure is directed away from joints of the thumb and index finger of the hand of the user while writing legibly with good quality.

In another embodiment there is disclosed a method for providing a writing instrument grip apparatus comprising the steps of:

providing a first member adapted to receive a user's thumb and index finger and having a substantially vertical cylindrical chamber for receiving said writing instrument adapted to extend past a bottom surface of said first member for contacting a surface for performing writing; and providing a second member adapted to receive a user's middle, ring, and small fingers coupled to a top of said first member, so that motion of the hand of the user powers said writing instrument for performing the writing in response to said motion;

wherein pressure is directed away from joints of the thumb and at least one finger of the hand of the user.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DETAILED DESCRIPTION OF THE INVENTION

Figure 1:
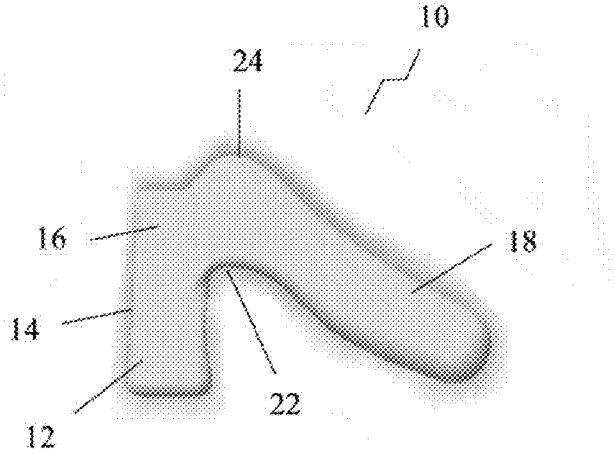
FIG. 1 is a left side view of a writing instrument grip apparatus in accordance with the principles of the invention.
Figure 2:
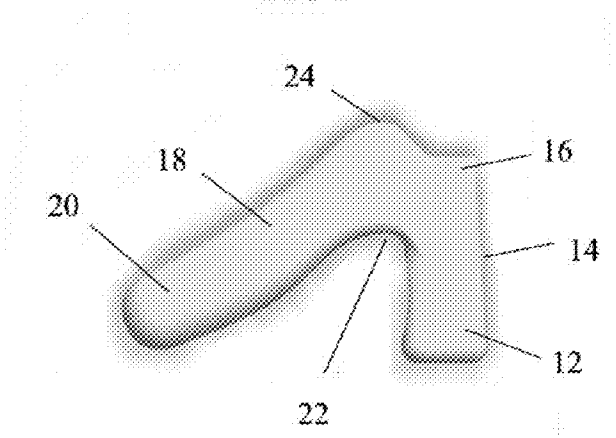
FIG. 2 is a right side view of the writing instrument grip apparatus of FIG. 1.

Referring to FIG. 1, there is shown an embodiment of a writing instrument grip apparatus in accordance with the principles of the invention. The writing instrument grip 10 includes a substantially triangular shaped vertical member 12 having a front facing rounded apex 14 is connected to a downward sloping support handle member 18 having a substantially cylindrical shape with contoured surfaces 20 that extend along the body of member 18, see FIG. 6. The junction 16 of support handle member 18 and vertical member 12 forms a generous inside radius 22 and a protrusion 24 located above the top of the vertical member 12.

The substantially triangular shaped vertical member 12 and the downward sloping support handle member 18 are neither rigid nor soft. They are composed of a unitary member of semi-rigid rubber of 60 DUROMETER TPE. The major dimensions of the various parts of the writing instrument grip apparatus shown in the FIGS. are CAD data which can be used to generate a 3-D model by a method which is known by those familiar with the CAD system. Using the CAD data, the writing instrument grip apparatus can be manufactured in various sizes to fit different size hands. It is noted that the writing instrument grip apparatus can be used by both left handed and right handed persons without modifications.

Figure 3:
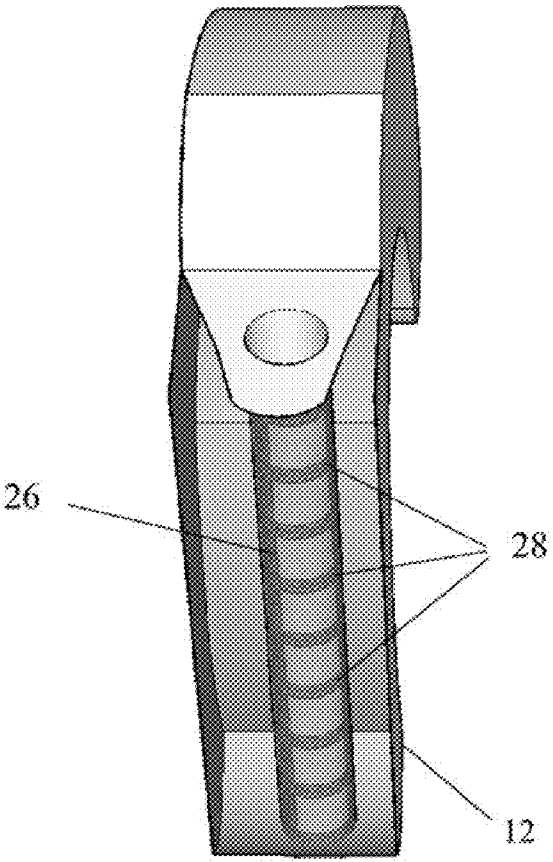
FIG. 3 is a sectional view of a receiving chamber having internally projecting concentric rings of pliable material for holding captive a writing instrument.

Referring to FIG. 3, there is shown a view of a cylindrical chamber 26 located in the substantially triangular shaped vertical member 12 for removably holding a writing instrument such as a pen or a pencil 30. The cylindrical chamber has a diameter which is slightly larger than the diameter of the pen or pencil which is used as a writing tool. Located within the cylindrical chamber is a plurality of projecting concentric rings of soft yieldable material 28 such as rubber or the like for removably holding captive a writing instrument.

The inside diameter of each concentric ring is smaller than the outside diameter of the writing instrument such as a pen or a pencil which will be inserted into the cylindrical chamber. In operation, as a writing instrument is inserted into chamber 26 from the top to the bottom, the projecting inside ends of the concentric rings will bend downward around the outside surface of the writing instrument to securely hold the writing instrument in position and prevent it from moving upwards as the writing instrument is pressed against a sheet of paper. During normal usage, the lower end of the writing instrument will be positioned to extend about one inch beyond the bottom surface of the vertical member 12.

Figure 4:
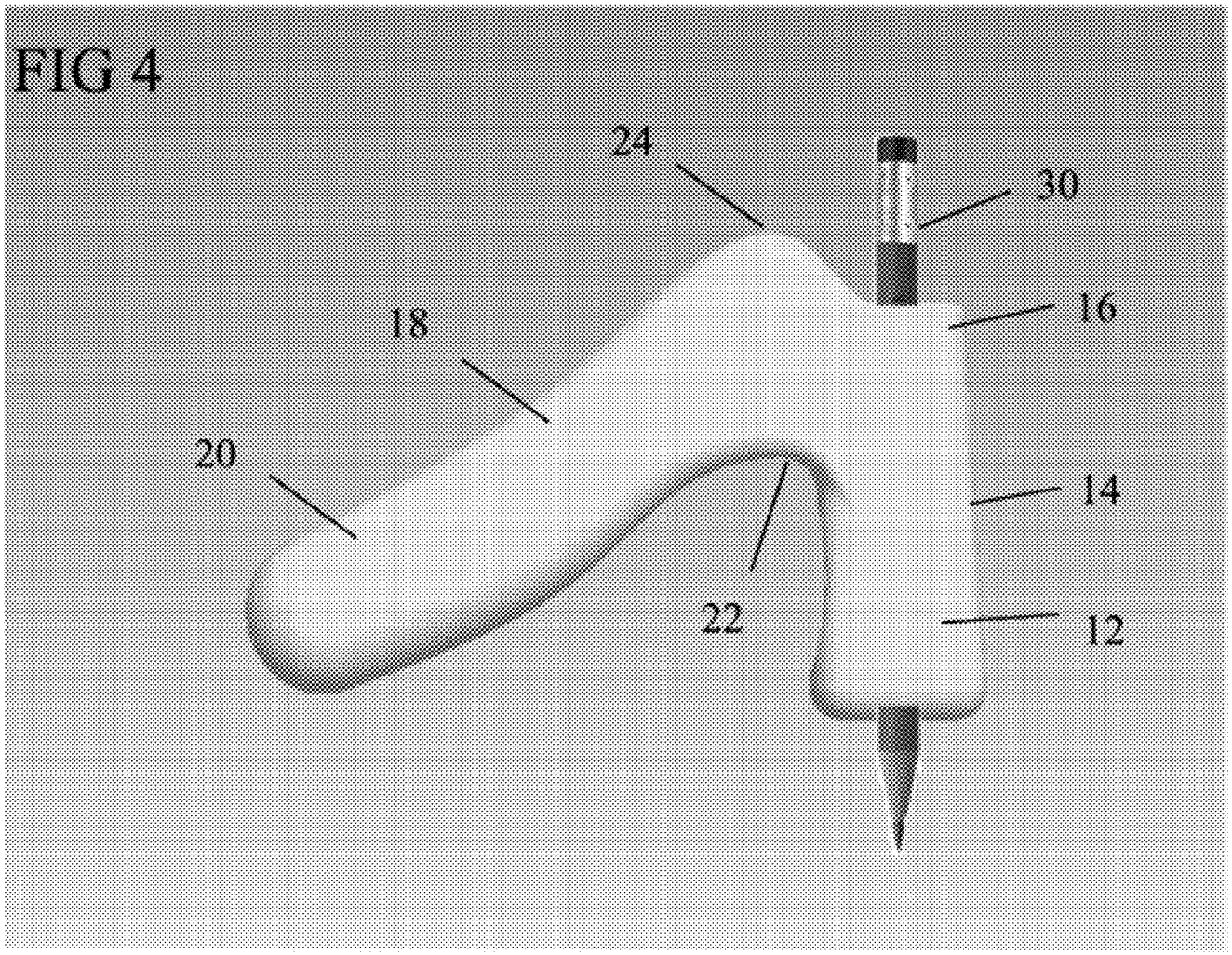
FIG. 4 is a right side view of the writing instrument grip apparatus of FIG. 1 holding a writing instrument.

Referring to FIG. 4, there is shown a side view of the writing instrument grip apparatus holding a pencil in position ready for use. It is understood that a writing instrument such as a pen can be substituted for the pencil and that the outside diameter of the pen can be different than the outside diameter of the pencil and still be held securely in place without being pushed upward when in use.

Figure 6:
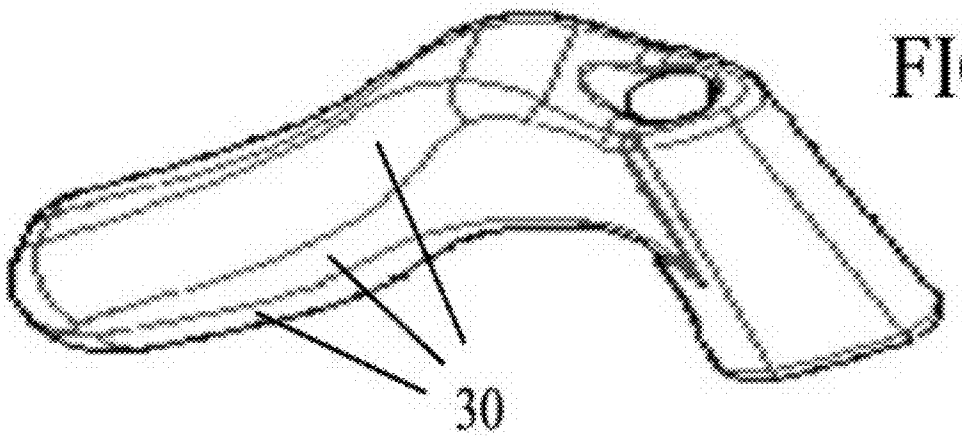
FIG. 6 is an isometric, superior view of the writing instrument grip apparatus in accordance with the principles of the invention.
Figure 7:
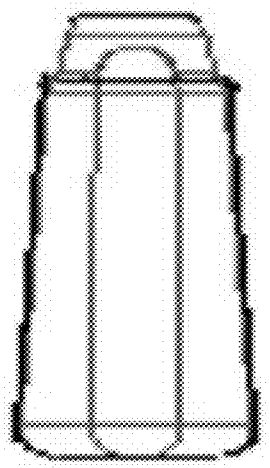
FIG. 7 is a front view of the writing instrument grip apparatus.

FIG. 6 shows an isometric, superior view of the writing instrument grip apparatus in accordance with the principles of the invention; and FIG. 7 is a front view of the writing instrument grip apparatus.

Figure 5:
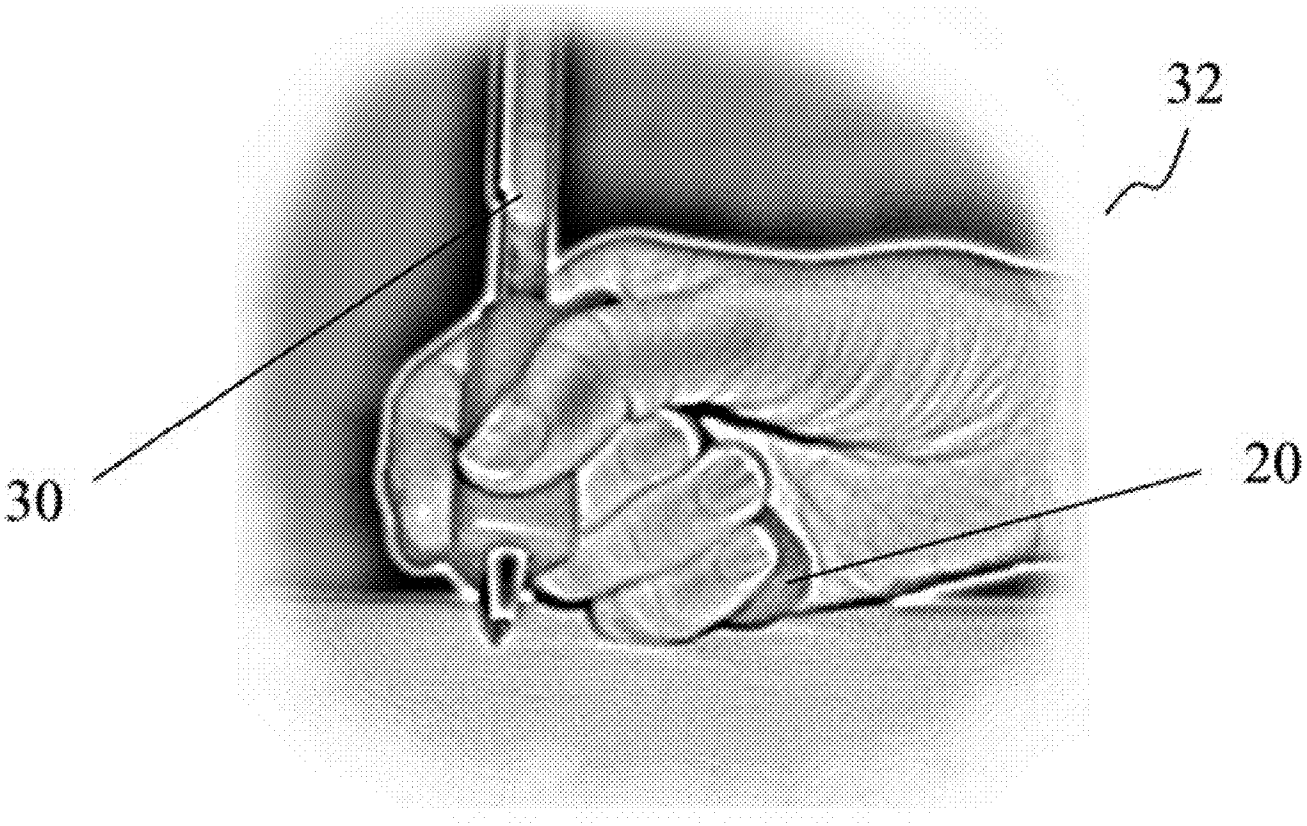
FIG. 5 is a view of the writing instrument grip apparatus being held in a preferred position by a right handed person while performing a writing task.

Referring to FIG. 5, there is shown a side view of the writing instrument grip apparatus being used by a person where the right hand 32 is the dominant hand. It is to be understood that the writing instrument grip apparatus here disclosed is not limited to use by a right handed person, but can also be used by a person where the dominant hand is the left hand.

In use, a pen or pencil is placed in the cylindrical chamber 26 in the vertical member 12 with the tip of the writing instrument protruding approximately one inch.

With the pen or pencil in position, a user positions the curved handle, high side under the index finger knuckle (second metocarpophalangeal joint) and wraps three fingers, the middle, ring and small fingers around the supporting handle member 18. The pads of the index finger and the thumb rest comfortably on the bottom of the vertical member 12 near the tip of the writing instrument.

Now, with the three fingers firmly clutching the support handle member 18, the user will immediately feel support assistance during the writing process.

The writing instrument grip here disclosed relieves hand stress and pain during handwriting tasks by ergonomically directing pressure away from the joints of the thumb and index finger of the hand while still offering the user the ability to create handwriting that is neat and legible. More specifically, the writing instrument grip transfers the primary pressure while writing from the thumb and index finger joint and spreads the work of handwriting across the arch and other digits of the hand. Also, the unique design of the curve in the vertical portion creates a relaxed open web space between the base of the thumb and index finger at the knuckles (first and second metocarpalphalangeal joints). The open web space is the best anatomical position for a writer of any age.

A person with no physical hand problem will experience little or no pain or fatigue when using the writing instrument grip apparatus here disclosed while writing for extended periods. A child or a person with a hand related physical problem such as poor muscle control which causes difficulty in holding a pen or pencil traditionally will now have more stability while writing.

While there have been shown and described and pointed out the fundamental novel features of the invention as applied to the preferred embodiments, it will be understood that various omissions and substitutions and changes of the form and details of the apparatus illustrated and in the operation may be done by those skilled in the art, without departing from the spirit of the invention.

What is claimed is:

1. A writing instrument grip apparatus to hold a writing instrument to perform writing, comprising:

a substantially triangular shaped vertical member with a top and a bottom surface having a front facing rounded apex that is held by a user's thumb and a user's index finger; having a substantially vertical cylindrical chamber to receive and secure said writing instrument adapted to extend past said bottom surface of said first member to contact a surface to perform writing; and a downward sloping support handle member having a substantially cylindrical shape with a plurality of contoured surfaces attached to said vertical member at a side opposite to said rounded apex and near said top of said vertical member, which forms an inside radius and a protrusion at a junction of said vertical and support handle members, said support handle member is grasped by one or more of said user's fingers and said user's palm and inner hand to allow said user to write with said writing instrument on said surface, wherein pressure is directed away from one or more finger joints of one or more fingers of the user.

2. The writing instrument grip apparatus of claim 1, wherein said substantially vertical cylindrical chamber has a plurality of projecting concentric rings of soft yieldable material to hold said writing instrument.

3. The writing instrument grip apparatus of claim 2, wherein said projecting concentric rings each have a smaller inside diameter than an outside diameter of said writing instrument.

4. The writing instrument grip apparatus of claim 3, wherein said smaller inside diameters bend downward around said outside diameters of said writing instrument to securely hold the writing instrument in position and prevent the writing instrument from moving upwards as the writing instrument is pressed against the surface.

5. The writing instrument grip apparatus of claim 1, wherein said apparatus is made of semi-rigid rubber.

6. The apparatus of claim 1, wherein said writing instrument is extended and positioned approximately one inch beyond said bottom surface of said vertical member when the writing instrument is pressed against the surface.

7. The apparatus of claim 1, wherein said writing instrument is a pen.

8. The apparatus of claim 1, wherein said writing instrument is a pencil.

* * * * *